US006648695B1

(12) United States Patent
Wu

(10) Patent No.: US 6,648,695 B1
(45) Date of Patent: Nov. 18, 2003

(54) ELECTRICAL ADAPTER FOR CONNECTING CONNECTORS OF DIFFERENT INTERFACE

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/215,541

(22) Filed: Aug. 9, 2002

(51) Int. Cl.[7] ..... H01R 25/00
(52) U.S. Cl. ..... 439/638
(58) Field of Search ..... 439/638, 653, 439/488

(56) References Cited

U.S. PATENT DOCUMENTS 5,411,416 A * 5/1995 Balon et al. ..... 439/639
6,050,831 A * 4/2000 Wu et al. ..... 439/638
RE36,968 E * 11/2000 Shieh ..... 439/638
6,361,372 B1 * 3/2002 Chiang ..... 439/638
6,558,201 B1 * 5/2003 Begley et al. ..... 439/638

* cited by examiner

*Primary Examiner*—Tho D. Ta
*Assistant Examiner*—Briggette Hammond
(74) *Attorney, Agent, or Firm*—Wei Te Chung

(57) ABSTRACT

An electrical adapter (10) includes a serial Advanced Technology Attachment (ATA) plug connector (12) for connecting with a serial ATA receptacle connector (40) which connects with a serial ATA system backplane, and an Intelligent Drive Electronics (IDE) receptacle connector (14) for connecting with an IDE three-in-one header connector (50) which connects with an IDE HDD (hard disk drive).

13 Claims, 9 Drawing Sheets

ELECTRICAL ADAPTER FOR CONNECTING CONNECTORS OF DIFFERENT INTERFACE

FIELD OF THE INVENTION

The present invention relates to an electrical adapter, and particularly to an electrical adapter for interconnecting two connectors of different interface.

DESCRIPTION OF PRIOR ART

In the recent years, a three-in-one header connector of Intelligent Drive Electronics (IDE) interface becomes a popular connection interface. Generally, an IDE receptacle connector is mounted on a fiber channel backplane in the computer and an IDE plug connector is connected to a hard drive which is adapted to be attached to the fiber channel backplane for establishing signal transmission between the hard drive and the fiber channel backplane through the interconnection of such IDE receptacle and plug connectors.

Now, the serial Advanced Technology Attachment (serial ATA) interface is developing to connect storage devices such as hard disks to a computer motherboard. The storage devices will be collectively referred to hereinafter as "hard drive". The serial ATA interface offers more advantages compared to prior specialized interfaces. For example, the serial ATA system supports a low voltage requirement, low pin count, improves data robustness and high-speed transmission. Correspondingly, the serial ATA connectors are defined and are provided to respectively connect hard drive and backplane. Therefore, different interface standard connection may be applied in a computer interior structure.

As stated above, the present problem people in the art confronts, is that a hard drive using a serial ATA plug connector may be required to connect with an existing fiber channel backplane which originally uses an IDE receptacle connector to connect with the hard drive, for the speed or other considerations. Under this situation, it is not convenient to wholly replace the system, which adds cost. Accordingly, an electrical adapter interconnecting the serial ATA plug connector and the IDE receptacle connector is desired. Hence, an electrical adapter is desired to meet the above-mentioned requirements.

BRIEF SUMMARY OF THE INVENTION

A first object of the present invention is to provide an electrical adapter which can connect one connector for an IDE HDD (hard disk drive) to another connector for a serial ATA system backplane;

Another object of the present invention is to provide an electrical adapter assembly for electrically connecting an IDE HDD to a serial ATA system backplane;

To fulfill the above-mentioned objects, an electrical adapter in accordance with the present invention is adapted for electrically connecting a serial ATA system backplane on which a serial ATA receptacle connector is mounted to an HDD on which an Intelligent Drive Electronics (IDE) three-in-one header connector is mounted. The adapter has a serial ATA plug connector for engaging with the serial ATA receptacle connector of the backplane, and an IDE receptacle connector opposite to the serial ATA plug connector for electrically connecting with a corresponding plug connector of the IDE three-in-one header connector.

Other objects, advantages and novel features of the invention will become more apparent from the following detailed description of the present embodiment when taken in conjunction with the accompanying drawings.

DETAILED DESCRIPTION OF THE INVENTION

Figure 1:
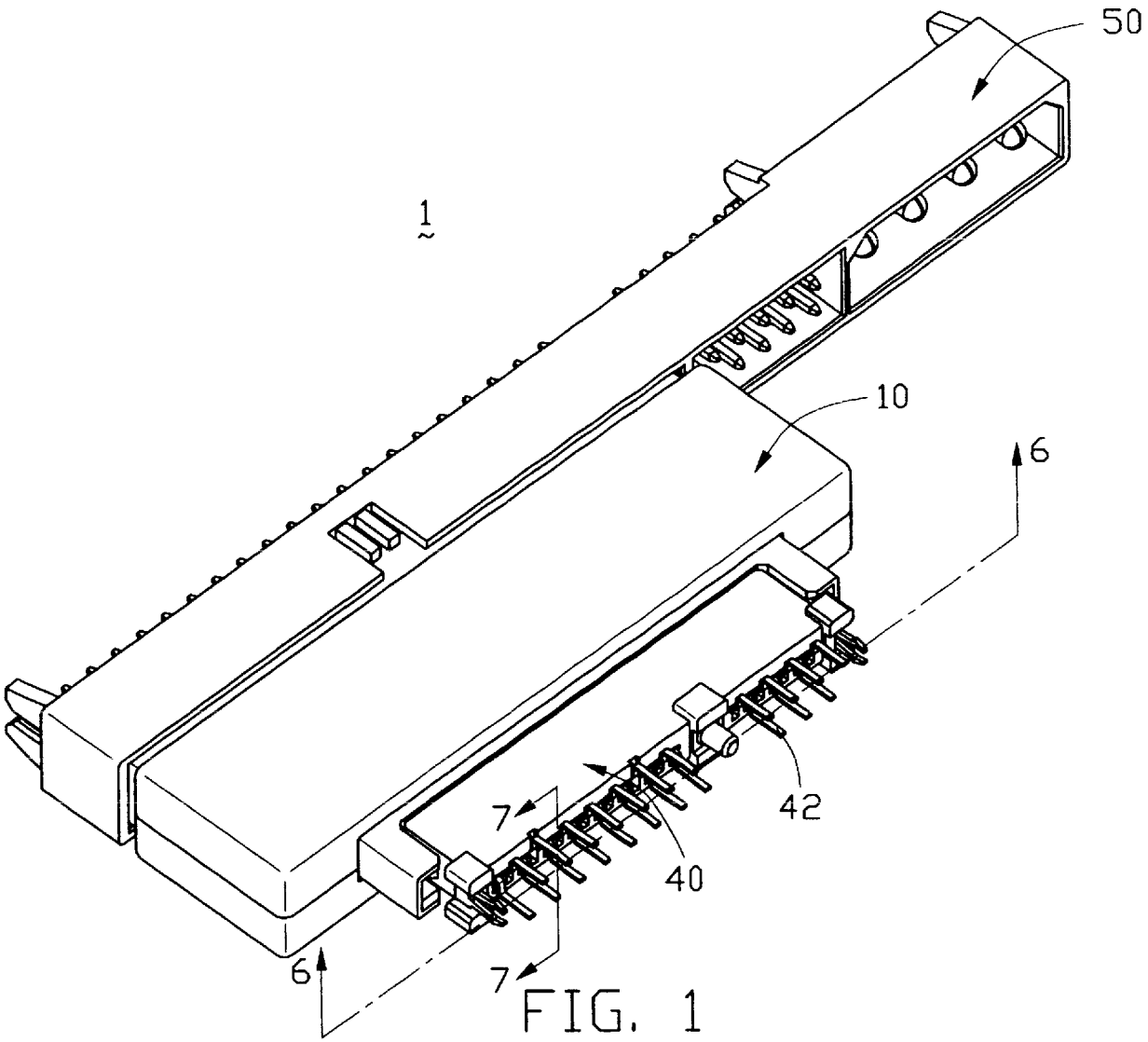
FIG. 1 is a perspective view of an electrical adapter assembly in accordance with the present invention.
Figure 2:
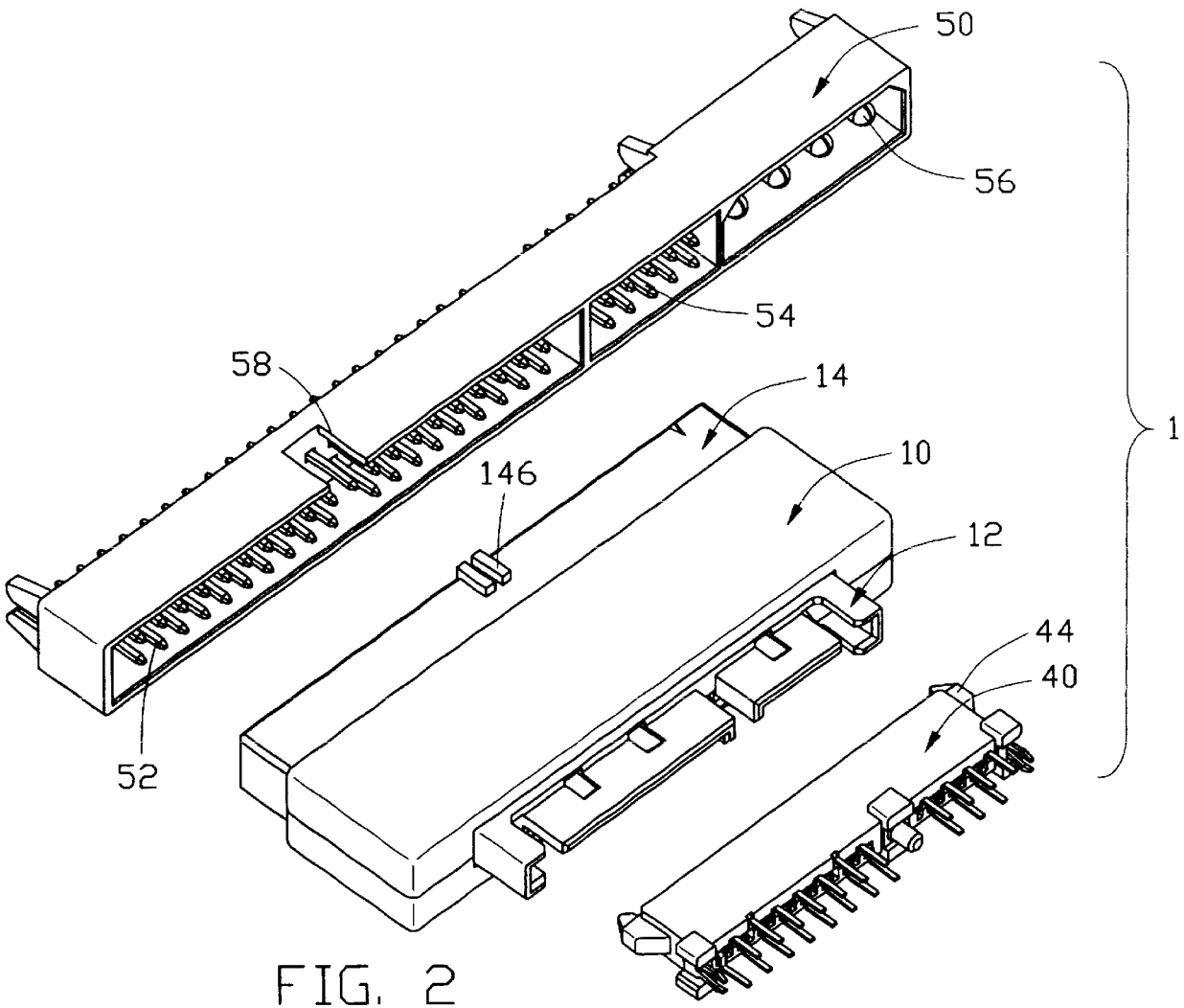
FIG. 2 is an exploded view of FIG. 1.
Figure 3:
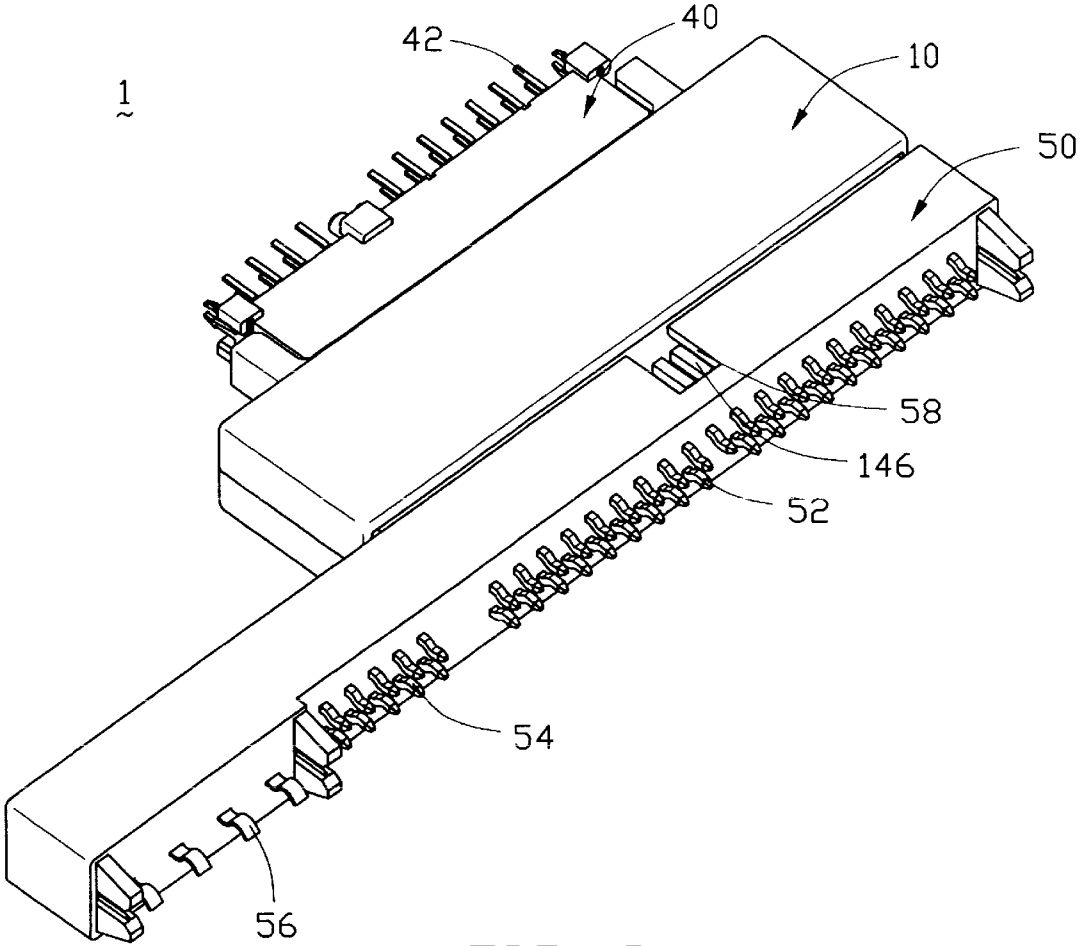
FIG. 3 is a perspective view similar to FIG. 1, but viewed from an opposite aspect.
Figure 4:
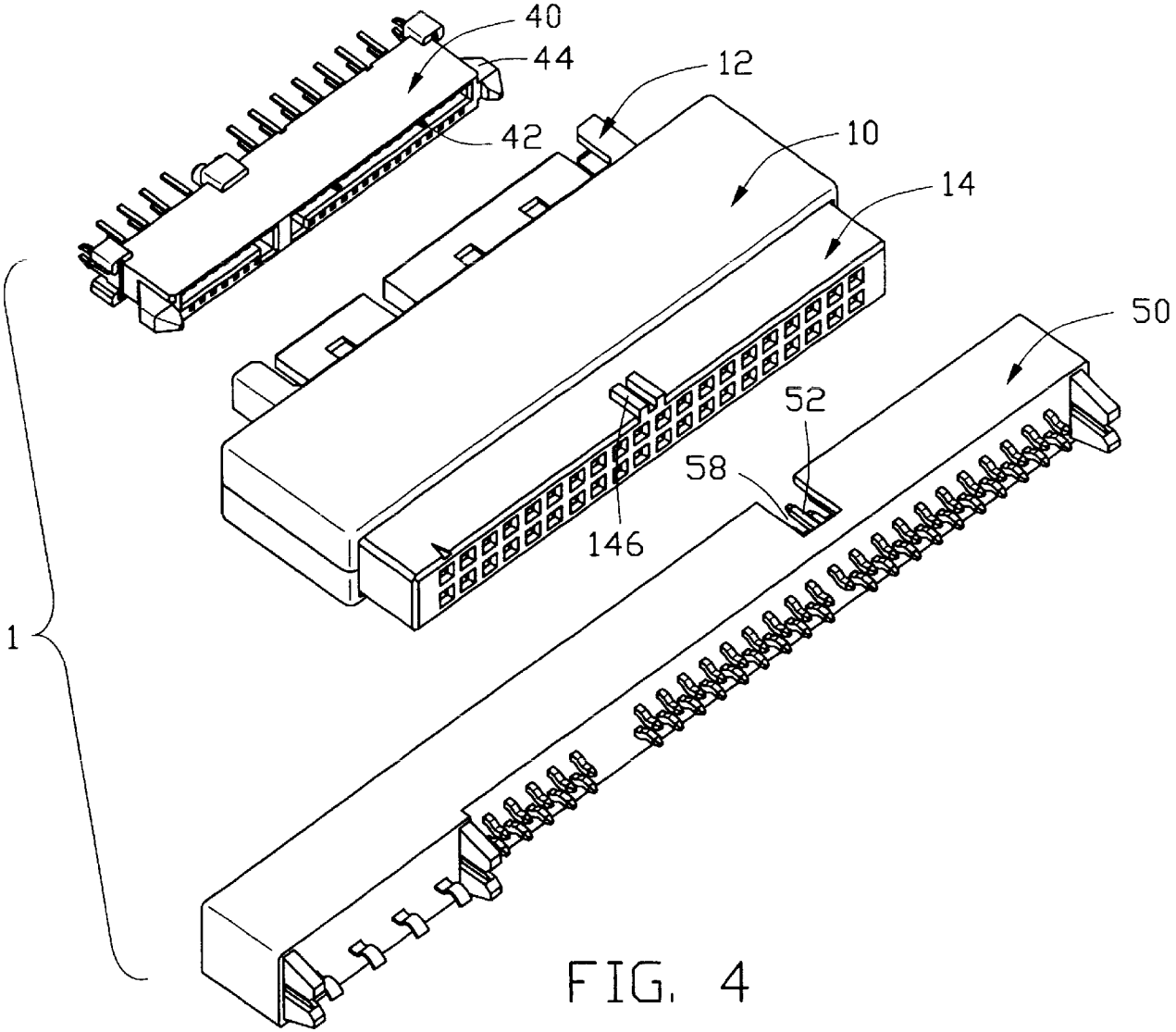
FIG. 4 is an exploded view of FIG. 3.
Figure 5:
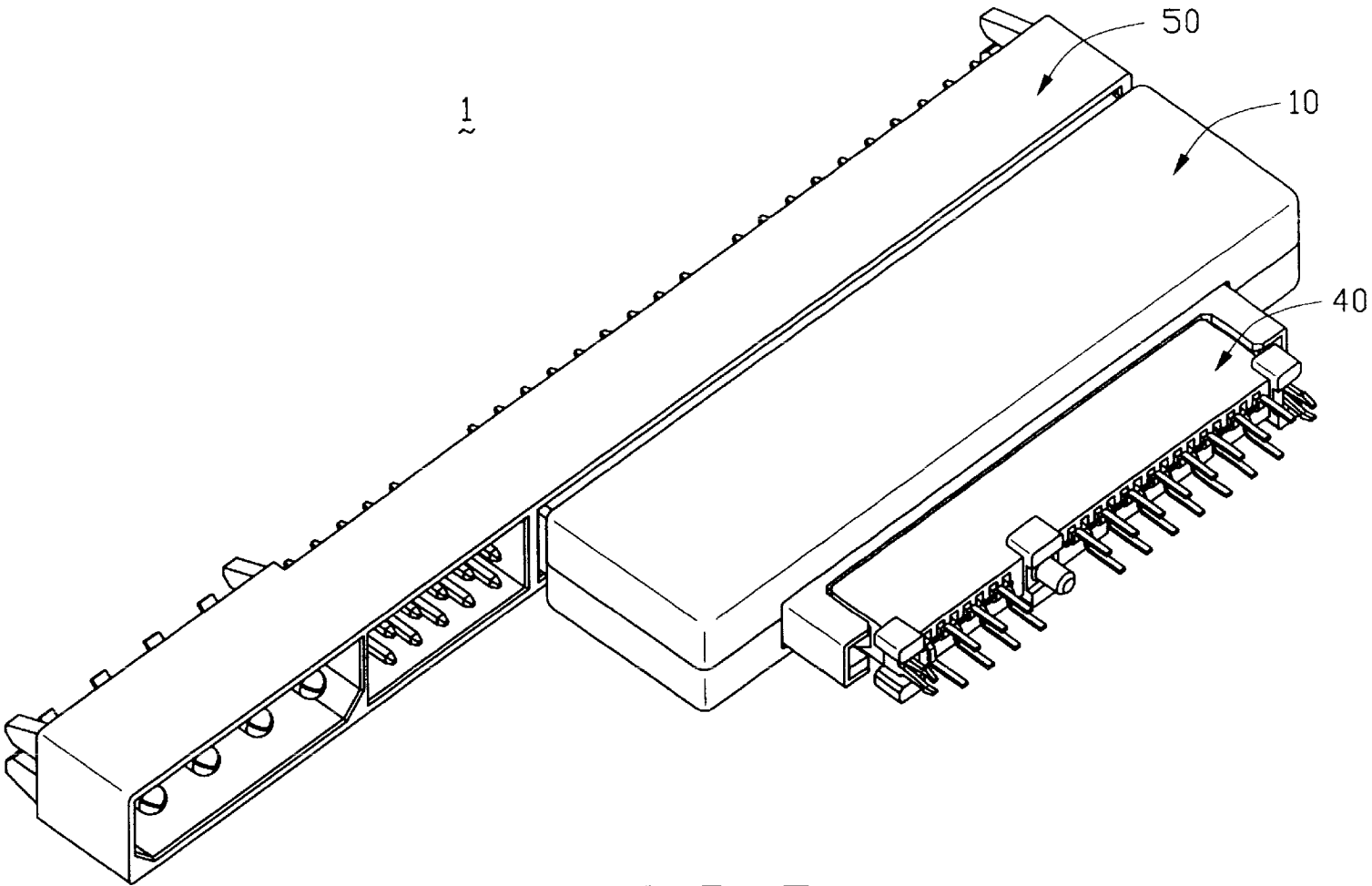
FIG. 5 is an upside-down, perspective view of FIG. 1.

Reference will now be made to drawings, and particularly to FIG. 1. An electrical adapter assembly 1 in accordance with the present invention comprises an electrical adapter 10, a serial ATA receptacle connector 40 for connecting with a serial ATA system backplane (not shown), and an IDE three-in-one header connector 50 for connecting with an IDE HDD (not shown).

Also referring to FIGS. 2 to 5, the electrical adapter 10 comprises a serial ATA plug connector 12 for connecting with the serial ATA receptacle connector 40 and an IDE receptacle connector 14 for connecting with the IDE three-in-one header connector 50. The serial ATA receptacle connector 40 includes a plurality of first contacts 42. The IDE three-in-one header connector 50 includes a plurality of second contacts 52 arranged in two rows, a plurality of third jumper contacts 54 also arranged in two rows, and a plurality of power contacts 56 arranged in one row for transmitting power. The receptacle connector 14 of the adapter 10 has a pair of bars 146 formed on one side face thereof to mate with an opening 58 defined in one side face of the three-in-one header connector 50, thereby providing a blind-mating function.

Figure 6:
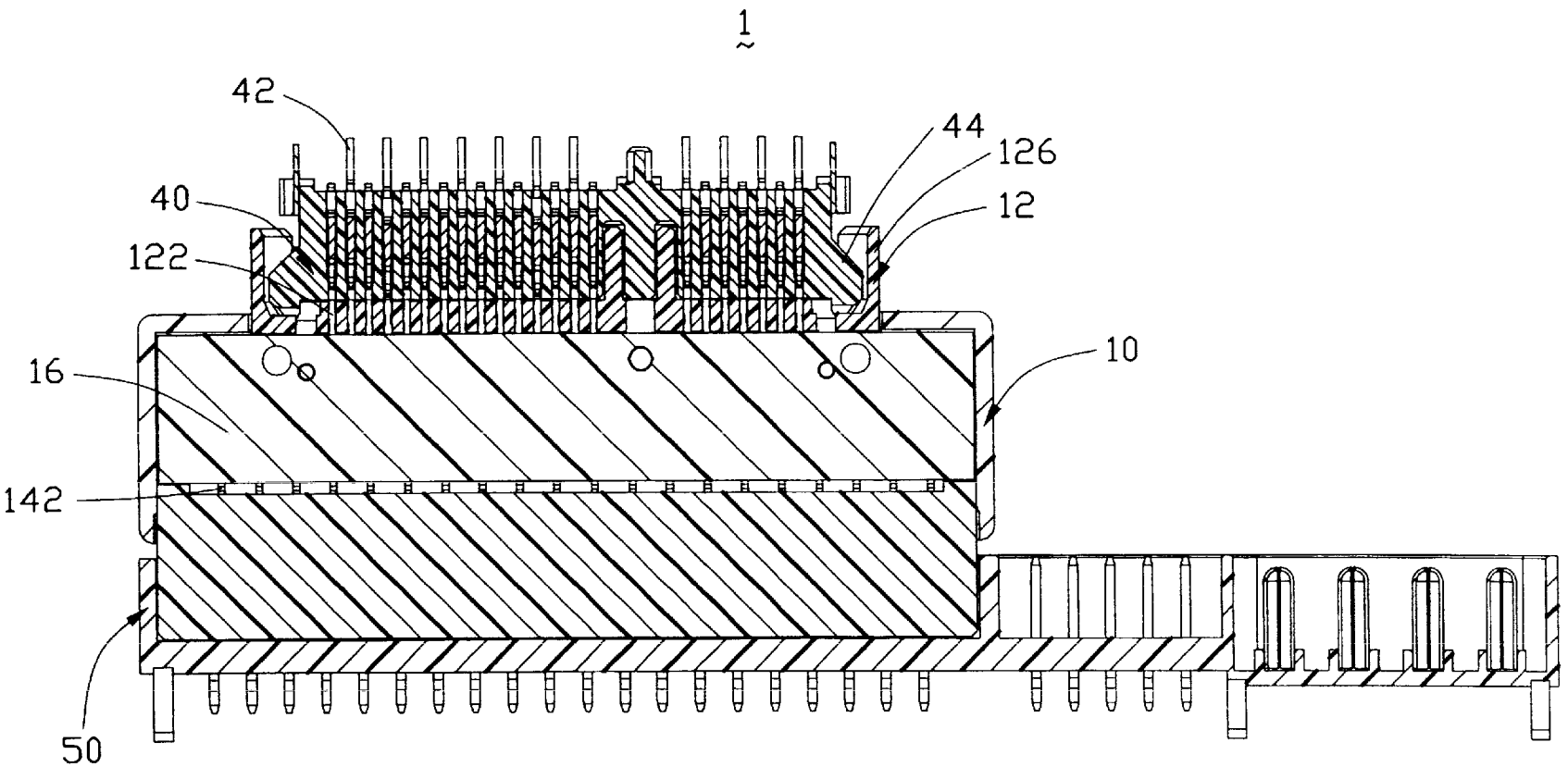
FIG. 6 is a cross-sectional view of the electrical adapter assembly taken along line 6—6 of FIG. 1.
Figure 7:
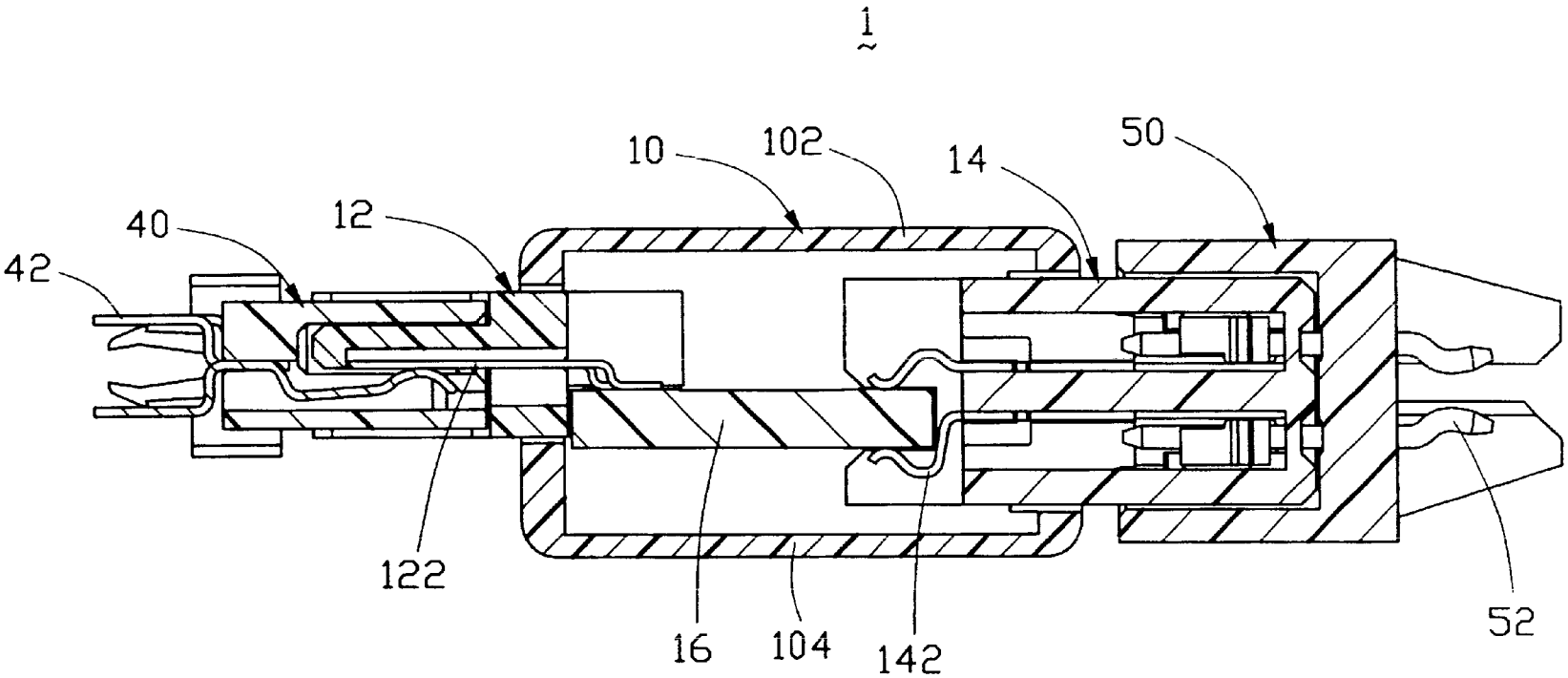
FIG. 7 is a cross-sectional view of the electrical adapter assembly taken along line 7—7 of FIG. 1.
Figure 8:
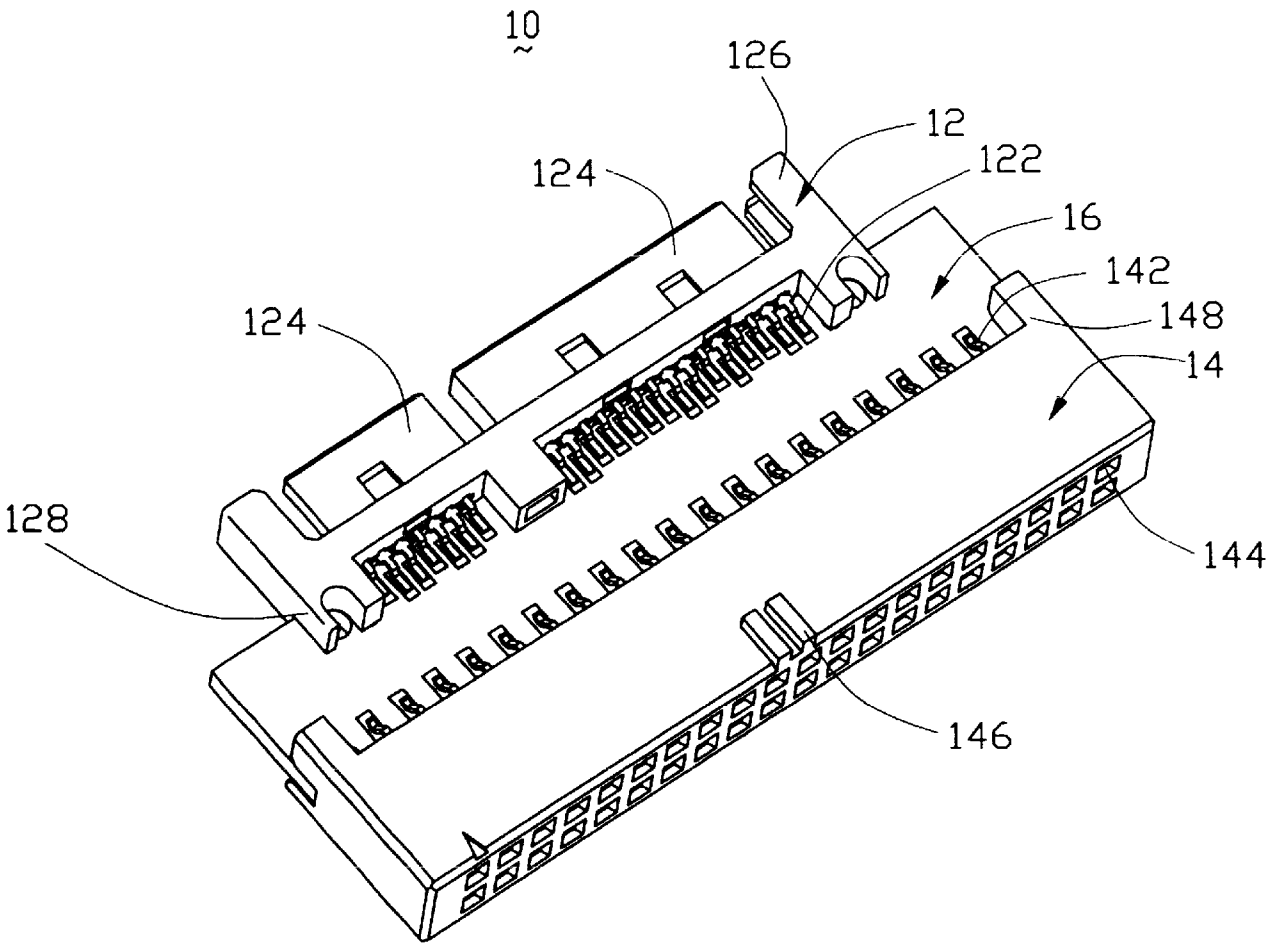
FIG. 8 is a perspective view of an electrical adapter in accordance with the present invention.
Figure 9:
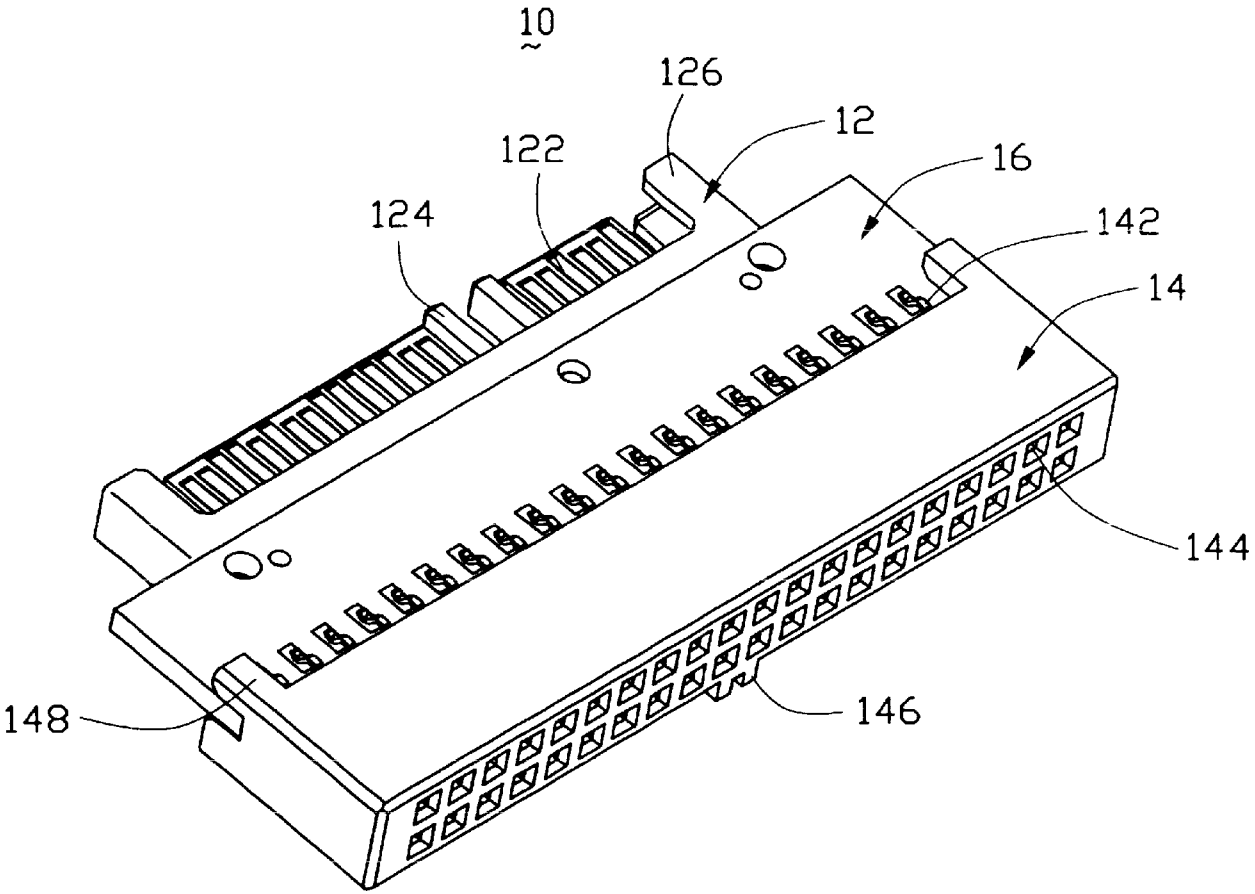
FIG. 9 is an upside-down, perspective view of FIG. 8.

Also referring to FIGS. 6 and 9, the serial ATA plug connector 12 of the electrical adapter 10 comprises a pair of tongue portions 124 for mating with corresponding mating portions (not labelled) of the serial ATA receptacle connector 40, a plurality of first terminals 122 for connecting with the first contacts 42 of the serial ATA receptacle connector 40, a pair of guiding portions 126 at outside of the two tongue portions 124 for respectively receiving a pair of latches 44 of the serial ATA receptacle connector 40, and a pair of first retainers 128 connecting with the guiding portions 126 and extending in a direction opposite to the guiding portions 126. The IDE receptacle connector 14 comprises a plurality of second terminals 142 received in a plurality of receiving passageways 144 thereof for connecting with the second contacts 52 of the IDE three-in-one header connector 50, and a pair of second retainers 148 formed at opposite ends thereof and extending toward the first retainers 128. The electrical adapter 10 further comprises a printed circuit board (PCB) 16 interconnecting the first terminals 122 and the second terminals 142, and a top cover 102 and a bottom cover 104 formed as an integral part. The first retainers 128 are respectively assembled on the PCB 16 via a screw (not shown). The second retainers 148 sandwich one side edge of the PCB 16. The first terminals 122 of the serial ATA plug connector 12 are mounted on the PCB 16 through surface mounting technology (SMT), and the second terminals 142 of the IDE receptacle connector 14 are surface mounted on opposite side surfaces of the PCB 16. The PCB 16 is available from the Highpoint Company. The only difference between the PCB 16 of this invention and the PCB of the Highpoint is the use or application. Referring to FIG. 7, the first contacts 42 of the serial ATA receptacle connector 40 for connecting with the serial ATA system backplane are connected with the first terminals 122 of the adapter 10, the first terminals 122 of the adapter 10 are electrically connected with the second terminals 142 of the adapter 10 via the PCB 16, and the second terminals 142 of the adapter 10 are connected with the second contacts 52 of the three-in-one header connector 50 for connecting with the IDE HDD. Thus, an electrical path between the IDE HDD and the serial ATA system backplane is established.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical adapter assembly for electrically connecting an Intelligent Drive Electronics (IDE) hard disk drive (HDD) with a serial Advanced Technology Attachment (ATA) system backplane, comprising:

a serial ATA receptacle connector comprising a plurality of first contacts adapted for connecting with a serial ATA system backplane;

an IDE three-in-one header connector comprising a plurality of second contacts adapted for connecting with an IDE HDD; and an electrical adapter comprising a serial ATA plug connector for connecting with the serial ATA receptacle connector, an IDE receptacle connector for connecting with the IDE three-in-one header connector, and a printed circuit board, the serial ATA plug connector comprising a plurality of first terminals for connecting with the first contacts of the serial ATA receptacle connector, the IDE receptacle connector comprising a plurality of second terminals for connecting with the second contacts of the IDE three-in-one header connector, the printed circuit board interconnecting the first terminals and the second terminals.

2. The electrical adapter assembly as claimed in claim 1, wherein the IDE three-in-one header connector includes a plurality of third jumper contacts arranged in two rows and a plurality of power contacts arranged in one row for transmitting power.

3. The electrical adapter assembly as claimed in claim 1, wherein the IDE receptacle connector of the adapter has a pair of bars formed on one side face thereof, and the IDE three-in-one header connector comprises an opening defined in one side face thereof for receiving the pair of bars.

4. An electrical adapter for connecting an Intelligent Drive Electronics (IDE) three-in-one header connector for an IDE hard disk drive (HDD) with a serial Advanced Technology Attachment (ATA) receptacle connector for a serial ATA system backplane, comprising:

a serial ATA plug connector adapted for connecting with a serial ATA receptacle connector for a serial ATA system backplane, the serial ATA plug connector comprising a plurality of first terminals adapted for connecting with first contacts of the serial ATA receptacle connector;

an IDE receptacle connector adapted for connecting with an IDE three-in-one header connector for an IDE HDD, the IDE receptacle connector comprising a plurality of second terminals adapted for connecting with second contacts of the IDE three-in-one header connector; and a printed circuit board (PCB) for connecting the first terminals to the second terminals.

5. The electrical adapter as claimed in claim 4, wherein the IDE receptacle connector has a pair of bars formed on one side face thereof adapted for engaging an opening defined in one side face of the IDE three-in-one header connector.

6. The electrical adapter as claimed in claim 4, wherein the IDE receptacle connector comprises a plurality of receiving passageways for receiving the second terminals.

7. The electrical adapter as claimed in claim 4, wherein the first terminals of the serial ATA plug connector are mounted on one side surface of the PCB through surface mounting technology (SMT) and the second terminals of the IDE receptacle connector are mounted on opposite side surfaces of the PCB through SMT.

8. The electrical adapter as claimed in claim 4, further comprising a top cover and a bottom cover integrally formed with each other.

9. The electrical adapter as claimed in claim 4, wherein the serial ATA plug connector comprises a pair of tongue portions adapted for mating with corresponding mating portions of the serial ATA receptacle connector, and a pair of guiding portions at outside of the two tongue portions adapted for respectively receiving a pair of latches of the serial ATA receptacle connector.

10. The electrical adapter as claimed in claim 9, wherein the serial ATA plug connector comprises a pair of first retainers connecting with the guiding portions and extending in a direction opposite to the guiding portions for being mounted on the PCB.

11. The electrical adapter as claimed in claim 10, wherein the IDE receptacle connector comprises a pair of second retainers formed at opposite ends thereof and extending toward the first retainers of the serial ATA plug connector, the second retainers sandwiching one side edge of the PCB.

12. An electrical connection system comprising:

an IDE (Intelligent Drive Electronics) three-in-one header connector defining a first lengthwise dimension (D1) thereof;

a serial ATA (Advanced Technology Attachment) receptacle connector defining a second lengthwise dimension (D2) thereof; and an adapter including a built-in printed circuit board with a serial ATA plug connector, on one side thereof, coupled to the serial ATA receptacle connector, and an IDE receptacle connector, on the other side thereof, coupled to the three-in-one header connector, said adapter defining a third lengthwise dimension (D3) thereof; wherein under a condition of D1>D3>D2, some mating ports of the three-in-one header connector are not coupled by the IDE receptacle connector.

13. The connection system as claimed in claim 12, wherein said printed circuit board is not located on a mid-level of the adapter for compliance with two rows contact arrangement of the IDE receptacle connector on one side thereof and one row contact arrangement of the serial ATA plug connector on the other side thereof.

* * * * *